United States Patent [19]

Carmean

[11] Patent Number: 4,835,379

[45] Date of Patent: May 30, 1989

[54] X-RAY SENSITIVE CAMERA PICK-UP TUBE

[75] Inventor: Ronald E. Carmean, Madison, Wis.

[73] Assignee: Nicolet Instrument Corporation, Madison, Wis.

[21] Appl. No.: 157,283

[22] Filed: Feb. 18, 1988

[51] Int. Cl.[4] ..... H01J 31/50

[52] U.S. Cl. ..... 250/213 VT; 313/543

[58] Field of Search ..... 250/213 VT; 313/525, 313/543

[56] References Cited

U.S. PATENT DOCUMENTS 3,783,299 1/1974 Houston ..... 250/213 VT 4,371,806 1/1983 Bintig et al. ..... 313/543

*Primary Examiner*—Edward P. Westin

*Assistant Examiner*—Khaled Shami

*Attorney, Agent, or Firm*—Lathrop & Clark

[57] ABSTRACT

An X-ray sensitive camera pick-up tube has an input end that has a circular glass surface that has areas of phosphor coating and of bare surface. The area of phosphor coating is a rectangle that fits within the circular glass surface and is limited to the area used for X-ray imaging of a specimen placed in front of the input end.

7 Claims, 2 Drawing Sheets

X-RAY SENSITIVE CAMERA PICK-UP TUBE

FIELD OF THE INVENTION

This invention relates to X-ray sensitive cameras, primarily to X-ray video pick-up tubes for use with X-ray microscopes and other X-ray imaging systems.

BACKGROUND OF THE INVENTION

X-ray cameras are commonly employed in X-ray imaging systems such as X-ray microscopy, these systems being commonly used in such fields as crystallography or microanalysis. X-ray sensitive pick-up tubes employed in such cameras are similar to ordinary television camera tubes, such as fiber optic Vidicon tubes, except that a phosphor coating is added to the front of the input face of the tube. The phosphor coating is used because the coating causes a visible fluorescence in the presence of X-rays, whereas ordinary television camera tubes are insensitive to X-rays and thus cannot directly record X-ray images. The fluorescence produced by the fluorescent coating is visible light which is then sensed by the tube in the same manner as any other visible light image would be recorded.

Due to variations and fluctuations in the intensity of X-rays produced by X-ray sources, adjustments must be made to the bias and sensitivity range of the tube so that the resulting video image has a suitable range of intensities. A typical adjustment involves the placing of an opaque (e.g. lead) mask over the phosphor coating to eliminate fluorescence in a chosen region of the image frame, and establishing what is known in the art as a "black level reference." Unfortunately, the use of such a mask to establish this reference is often a tedious and difficult task. Care must be taken to align the mask with the rest of the optical elements in the X-ray optical path. A difficulty is that an X-ray source must be turned on for some aspects of the adjustment and calibration (e.g. fine tuning), and because of the danger of over-exposure to X-ray radiation, operators must be shielded from such sources, and from the tubes, during these alignment operations. This complicates both the manufacture and field service of instruments using these devices.

SUMMARY OF THE INVENTION

In accordance with the present invention, an X-ray camera sensitive pick-up tube is disclosed that reduces the overall size of the phosphor coating relative to the size of the recording element. The X-ray camera sensitive pick-up tube of the present invention limits the X-ray sensitive phosphor coating to a rectangular area that is slightly smaller than the area that is used for X-ray imaging. The surrounding area is rendered bare of phosphor and results in a clear mask which appears black, in the absence of a light image, because the clear mask is non-reactive to the X-rays due to absence of the phosphor coating. In use, the X-ray camera tube produces an image with a thin, dark band around its periphery that functions as a black level reference around the image. The lack of phosphor produces a black level reference because there is no visible light source in those areas. A black level reference for X-ray images is thus provided in a manner much more conveniently than the more cumbersome lead mask previously used.

The pick-up tube of the present invention has several advantages not obtainable with the previous separate mask and tube schemes. Because of the bare face plate area, it may be completely adjusted and calibrated outside of an X-ray environment, with only visible light optical illumination. Previous tubes could only be fine tuned in the presence of X-rays, which is a time consuming inconvenience in manufacturing and field service. The tube of the present invention, however, produces a conventional optical image when it is over-scanned in the areas outside of the phosphor coating. To over-scan, the horizontal and vertical scan sizes are increased so that the phosphor coated area appears as a black rectangle in the center of a visible light image. Between the phosphor rectangle and the edge of the picture, the face plate of an X-ray pick-up tube according to the present invention acts as a conventional optical spectrum pick-up tube. By removing the X-ray window and installing a lens, one can project a visible spectrum test pattern on the face plate and follow all of the conventional optical set-up procedures, all in visible light. The final scan size can be set up on the light box by decreasing horizontal and vertical size until a thin band of light remains around the outside of the black rectangle.

Further objects, features, and advantages of the invention will be apparent from the following detailed description taken in conjunction with the accompanying drawings.

DESCRIPTION OF THE PREFERRED EMBODIMENT

Figure 1:
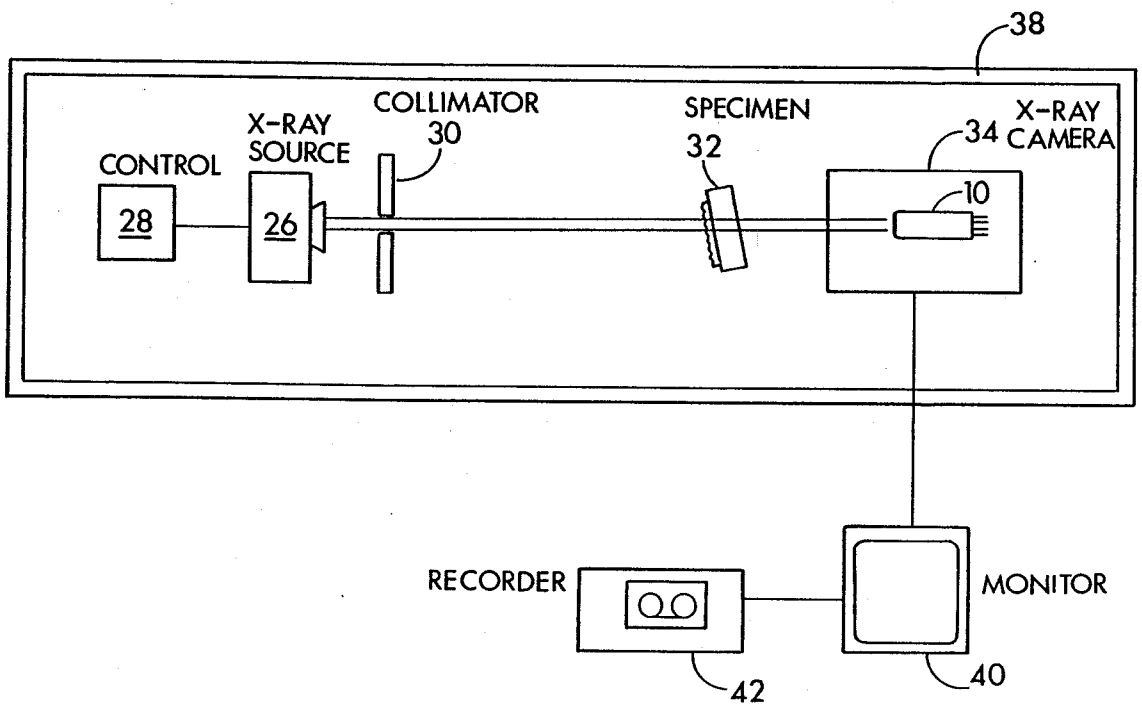
FIG. 1 is a schematic representation of a typical X-ray imaging system that employs an X-ray sensitive camera pick-up tube.
Figure 3:
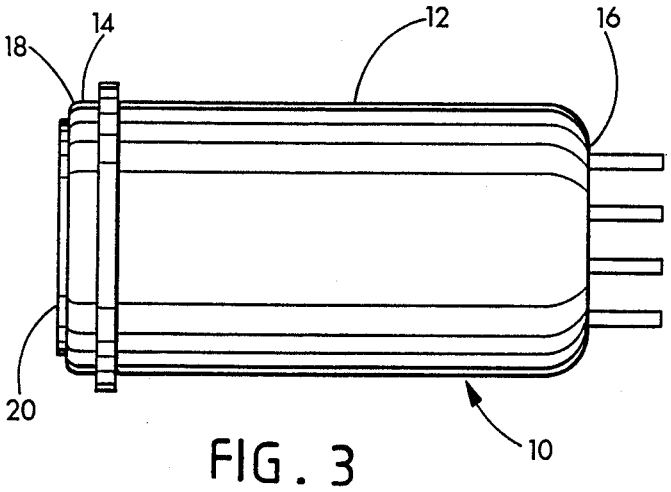
FIG. 3 is a side view of the camera pick-up tube.
Figure 2:
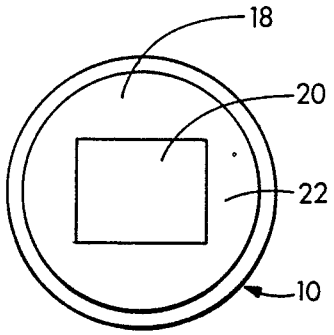
FIG. 2 is a front view of the camera pick-up tube, showing areas of phosphor coating on the input to the tube.

With reference to the drawings, an X-ray sensitive camera pick-up tube in accordance with the invention is shown at 10 in FIGS. 1, 2 and 3. The pick-up tube 10 has the general shape of a cylinder 12 extending between an input end 14 and an output end 16. The input end 14 has a circular glass surface 18 that is selectively partially coated with phosphor coating to form an X-ray image area 20, preferably in a rectangular shape. Surrounding the X-ray image area 20 on the input end 14 of the pick-up tube 10 is a reference area 22 of bare glass on which there is no phosphor coating. The reference area 22 represents the remainder of the glass surface 18 that is not coated with the phosphor. The camera pick-up tube 10 is an ordinary television camera tube (e.g. fiber optic vidicon, fiber optic Newvicon) except that the phosphor coating of the X-ray image area 20 has been added to the glass surface 18 of the input end 14.

An exemplary phosphor applied to the circular glass surface 18 of the present invention is gadollinium oxysulfide doped with terbium, as commonly used in television sets and other video equipment. To apply the phosphor coating 20 to an otherwise conventional visual light television camera tube, the circular glass surface 18 is first cleaned with ethanol, detergent, and water. The phosphor is settled through a layer of solvent, such as amyl acetate. The phosphor and solvent are mixed with a binder, e.g. cellulose acetate or cellulose nitrate, to form a solution that has high viscosity and low ionic potential. The solution is continuously mixed until used, and at that time is physically poured onto the circular glass surface 18 of the pick-up tube 10 to form a meniscus. The circular glass surface 18 is covered and allowed to dry, the cover acting to prevent the solution from evaporating too rapidly, which causes unacceptable cracking of the phosphor coating. This process typically will produce a 30% yield in usable camera pick-up tubes, the remainder being unacceptable for cracking of the phosphor coating or for other reasons. The above steps to create the phosphor coating of the X-ray image area 20 are preferably undertaken in a clean environment. When dry, the X-ray image area 20 is then reduced in area to its preferable rectangular shape by cutting out the peripheral areas of the phosphor coating to form the reference area 22. A razor or other cutting instrument is used to selectively limit the phosphor and form the bare reference area 22. The phosphor coating 20 is preferably shaped rectangularly to accommodate the projection of an image upon a rectangular screen of a television monitor 40, explained below.

As shown very schematically in FIG. 1, the camera pick-up tube 10 is often used as a part of an X-ray microscopy viewing system 24 that typically comprises an X-ray source 26, X-ray control 28, a collimator 30, a representative specimen 32 which is illuminated by the X-rays generated from the X-ray source 26, an X-ray camera 34 including therein an X-ray pick-up tube 10, an X-ray cell wall 38, a television monitor 40, and a video tape apparatus 42. Upon generation of the X-rays from the X-ray source 26, the collimator 30 lines up the X-rays with the specimen 32. The cell wall 38 protects the electronic components and the user from the X-rays. The X-ray camera 34 with the X-ray pick-up tube 10 converts the X-ray image created by the striking of the X-rays upon the specimen 32 into an electronic signal by converting the X-ray image into an electronic charge pattern on a photoconductive target, which is read out by a scanning electron beam and displayed as a visible image on a television monitor 40. The signal from the X-ray camera 34 is sent to the television monitor 40 located in a safe control location. The video tape apparatus 42 may be used to provide a permanent record of the inspection. The electronic signal derived from the pick-up tube 10 may be processed or analyzed in any appropriate way and by proper scaling or enlargement, can function as a microscopic viewer of the specimen 32.

Figure 4:
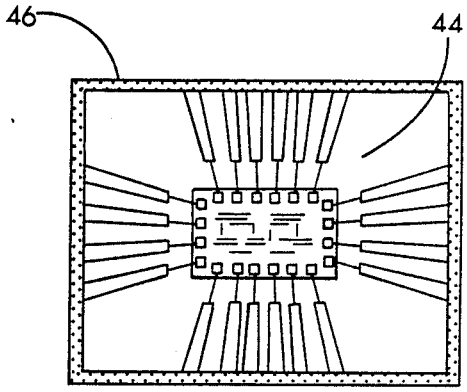
FIG. 4 is a view of the television monitor while receiving X-ray images, the outside band representing the clear mask that functions as a black level reference.

As shown in FIG. 4, the video image created by an X-ray camera using the X-ray pick-up tube 10 includes a rectangular, enlarged visible image 44 of the specimen 32 bordered by a dark band 46 on the television monitor 40. The image 44 is created when the X-rays strike the phosphor coating 20, because the X-rays and the phosphor react to produce fluorescence. The phosphor coating on the input end 14 of the camera pick-up tube 10 represents an area that is slightly smaller than the area that is used for X-ray imaging. The appropriate image size is selected by the biasing of the tube 10. The dark band 46 is created in an area that is unilluminated due to the lack of phosphor coating for the X-rays to react with. The dark band 46 may be used by the operator as a "black level reference" to aid in the adjustment of the gray scale video image 44. As an example, the "pedestal level" is a common adjustment parameter for television cameras in which the voltage is adjusted for the black level of the picture.

Figure 5:
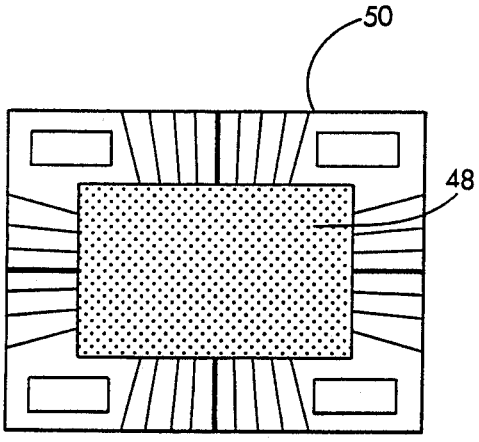
FIG. 5 is a view of the television monitor during calibration of the instrumentation, showing a test pattern in the background.

The present invention enables the operator to perform certain adjustments and calibrations without the need for an X-ray chamber and shielding. The X-ray sensitive camera pick-up tube 10 of the present invention may be calibrated totally by use of optical illumination. The area of phosphor coating 20 is opaque to optical illumination and appears black on the television monitor 40. When the horizontal and vertical scan sizes of the television monitor 40 are increased, the phosphor coating 20 appears as a black rectangle 48 in the center of a television image. Shown in FIG. 5 is a representation of the video image created during calibration in visible light. Between the dark rectangle 48 and the edge 50 of the television picture, the bare surface 22 acts as a conventional visual light pick-up tube. An optical test pattern may be presented and scanned by the pick-up tube 10 so that the test pattern will be exhibited on the television monitor 40 in those areas that correspond to the bare surface 22, as shown in FIG. 5. The operator may then follow all of the conventional set up procedures normally followed in calibration of the instrument using the tube 10. The final scan size can be set up by decreasing the horizontal and vertical on the television monitor 40 until a thin band of light remains around the outside of the black rectangle 48. This band of light then becomes the dark band 46 when the tube 10 is exposed only to X-rays to produce the aforementioned "black level reference."

It is understood that the invention is not confined to the particular construction and arrangement of parts herein illustrated and described, but embraces such modified forms thereof as come within the scope of the following claims.

What is claimed is:

1. A camera pick-up tube for use in X-ray imaging systems, comprising a cylinder having an input end and an output end, the input end having a glass surface that is only partially coated with phosphor and is partially uncoated so that the area of phosphor coverage upon the glass surface is limited to an area used for X-ray imaging so that the uncoated portion of the surface will create a black reference level in an X-ray image made with the tube.

2. A tube according to claim 1 wherein the area of phosphor coating on the input end is rectangular.

3. A tube according to claim 2 wherein the tube is calibrated so that the area of the video image produced by the tube is slightly larger than the area of the phosphor coating on the face of the tube so that the image has a black border to serve as a gray scale reference in the image.

4. A tube according to claim 1 wherein the phosphor is gadollinium oxysulfide doped with terbium.

5. A method of X-ray imaging comprising the steps of:

a. placing a specimen to be examined in front of the input end of a camera pick-up tube, the input end having a glass surface that is coated with phosphor in a selective manner so that the phosphor coverage is limited to an area that is to be used for X-ray imaging; and b. irradiating the specimen with X-rays to create an image in the camera pick-up tube, the portion of the glass surface not coated with phosphor providing a black reference level of the image.

6. The method of claim 5 further comprising the steps of:

a. projecting an optical test pattern through the parts of the input end that are not coated with phosphor; and b. calibrating a monitor that is exhibiting a signal from the camera pick-up tube, using the test pattern as a reference.

7. The method of claim 5 further comprising the step of adjusting the horizontal and vertical scan of a monitor that is receiving the signal of the camera pick-up tube so that the area that is to be scanned by the monitor is slightly larger than the area of the phosphor.

* * * * *